US006010659A

United States Patent [19]

Gentsch et al.

[11] Patent Number: 6,010,659

[45] Date of Patent: Jan. 4, 2000

[54] METHOD AND DEVICE FOR PRODUCING A CONTACT ELEMENT

[75] Inventors: Dietmar Gentsch, Ratingen; Georg Sawitzki, Velbert, both of Germany

[73] Assignee: ABB Patent GmbH, Mannheim, Germany

[21] Appl. No.: 08/872,219

[22] Filed: Jun. 10, 1997

Related U.S. Application Data

[63] Continuation of application No. PCT/EP96/04294, Oct. 12, 1996.

[30] Foreign Application Priority Data

Oct. 10, 1995 [DE] Germany ..... 195 37 657

[51] Int. Cl.[7] ..... B22F 3/26

[52] U.S. Cl. ..... 419/27; 425/78

[58] Field of Search ..... 419/27; 425/78

[56] References Cited

U.S. PATENT DOCUMENTS

| | | | |
|---|---|---|---|
| 2,200,088 | 5/1940 | Kelly | 200/166 |
| 2,422,439 | 6/1947 | Schwarkzkopf | 75/22 |
| 2,665,999 | 1/1954 | Koehring | 117/112 |
| 2,671,955 | 3/1954 | Grubel et al. | 29/182.5 |
| 2,798,809 | 7/1957 | Goetzel et al. | 75/200 |
| 2,851,381 | 9/1958 | Hoyer | 117/227 |
| 3,307,924 | 3/1967 | Michael | 29/182.5 |
| 5,017,334 | 5/1991 | Claar et al. | 419/12 |
| 5,828,941 | 10/1998 | Whitlow et al. | 419/17 |

*Primary Examiner*—Daniel J. Jenkins
*Attorney, Agent, or Firm*—Herbert L. Lerner; Laurence A. Greenberg

[57] ABSTRACT

A method of producing a contact element having a base body made of material with good electrical conductivity (first material) and a contact layer made of material with a less good electrical conductivity which is resistant to arc erosion (second material), includes impregnating a sinter structure of the contact layer with the material of the base body. The base body and the sinter structure are placed one above the other in a cup-like mold and are heated therein to above the melting temperature of the first material but still below the melting temperature of the second material, so that the first material fuses and penetrates into the sinter structure. The sinter structure may be produced by scattering the second material in powder form onto the first material and initially sintering in a degassing process below the melting temperature of the first material. It is also possible to produce the sinter structure in advance and to place a green body on the base body. A device for carrying out the method includes a cup-like mold formed of steel or stainless steel or a mold formed at least partially from ceramic.

27 Claims, 5 Drawing Sheets

Fig. 7
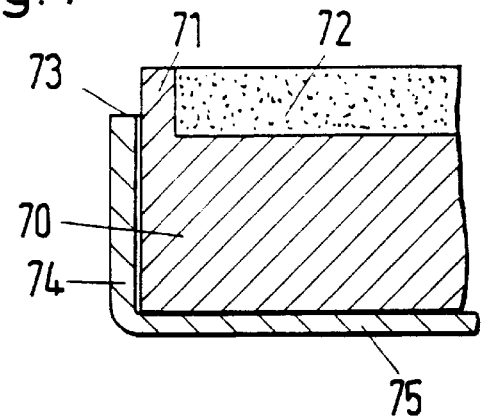
Fig. 8
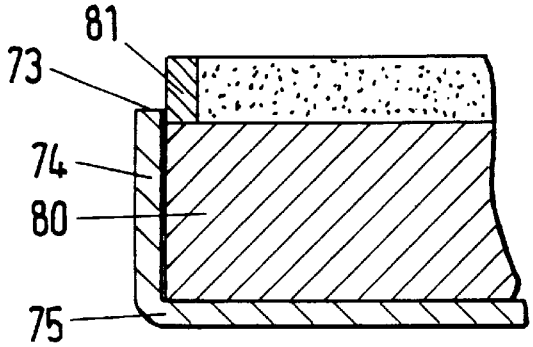
Fig. 10
Fig. 9
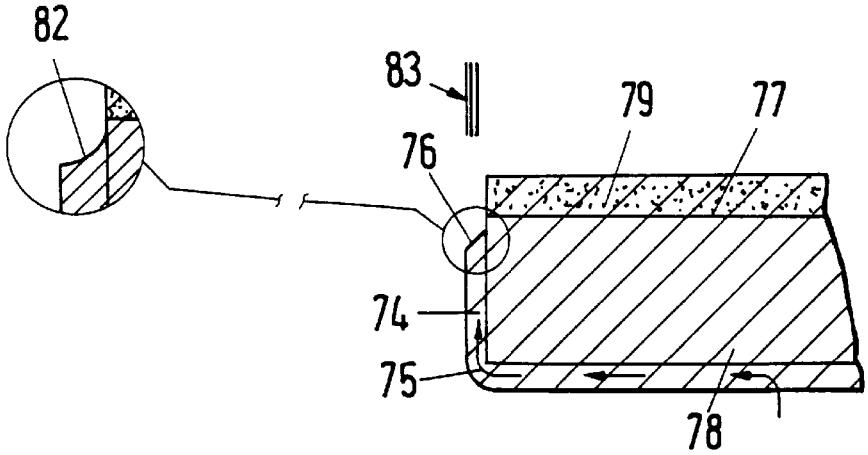

METHOD AND DEVICE FOR PRODUCING A CONTACT ELEMENT

CROSS-REFERENCE TO RELATED APPLICATION

This application is a Continuation of International Application Ser. No. PCT/EP96/04294, filed Oct. 12, 1996.

BACKGROUND OF THE INVENTION

Field of the Invention

The invention relates to a method of producing a contact element having a base body made of a material with a good electrical conductivity (first material) and a contact layer made of a material with a less good electrical conductivity which is resistant to arc erosion (second material), which includes impregnating a sinter structure of the contact layer with the material of the base body. The invention also relates to a device for carrying out the method, wherein a cup-like mold is formed of metal, preferably of steel or stainless steel or a mold is formed at least partially from ceramic.

Contact elements which have to conduct an arc during a switching operation must satisfy various conditions. Firstly, the contact element must have a sufficiently high electrical conductivity when the switch is closed. Secondly, the contact element must not erode too quickly when a switching arc is formed, so that the service life of the switchgear remains sufficiently high. While it is possible, in the case of gas-insulated high-voltage circuit breakers to divide the contact configuration into contact elements which conduct the rated current and contact elements which conduct the arc and accordingly have to be resistant to erosion, in the case of a vacuum circuit breaker it is not possible to provide any contact elements which conduct the rated current, so that the single contact-element configuration must conduct both the rated current as well as the arc.

In the event of a switching-off operation in a vacuum chamber, at certain current intensities a so-called contracted arc is formed, which is set in rotation by suitable shaping of the contact elements, so that the erosion of the contact material can be kept at a low level. Nevertheless, it is necessary to provide the surface of the opposite contact elements with erosion-resistant material, so that the erosion of the contact elements, as mentioned at the outset, remains low.

In the past, the contact elements for a vacuum circuit breaker have been made from two or more metallic components, in such a way that a sintered metal structure, which often is formed essentially of chromium, is impregnated with copper, so that a contact body made of a chromium-copper alloy is formed. On an industrial scale, such chromium-copper contacts may as a rule also be produced by sintering from a powder mixture of the corresponding metals, with contact elements in this case being formed which are made completely of this mixture.

Since the erosion-resistant material, for example chromium, has a lower electrical conductivity than copper, it has been sought to keep the chromium content in the complete contact element as low as possible, which has been accomplished in a very wide variety of ways. For example, a contact plate made of the composite metal may be applied to a base body. It is known, for example, from German Published, Non-Prosecuted Patent Application DE 31 07 688 A1 to coat the surface by a plasma spraying process.

German Published, Non-Prosecuted Patent Application DE 35 41 584 A1 has disclosed a method and a device for producing metal-composite materials and contact elements produced from those materials for electrical switchgear. In the case of those contact elements the surface of the base body is fused in some regions by using a suitable energy beam and pulverulent active components are fed to the volume of the melt and are incorporated into the base material.

In the method according to European Patent 0 458 922 B1, corresponding to U.S. Pat. No. 5,254,185, the substrate surface, that is to say the surface of the support body, is fused locally and the additional material is applied in the form of a loose powder layer to the substrate surface. As a result, the powder situated in the powder layer is wetted or the powder layer is impregnated with the liquid material from the fused local region, so that the powder of the powder layer is bound into the surface of the substrate and the desired surface layer is formed.

SUMMARY OF THE INVENTION

It is accordingly an object of the invention to provide a method and a device for producing a contact element, which overcome the hereinafore-mentioned disadvantages of the heretofore-known methods and devices of this general type, which are simple to carry out and which produce a contact element that has a good electrical conductivity with a high resistance to arc erosion and sufficient mechanical strength.

With the foregoing and other objects in view there is provided, in accordance with the invention, a method of producing a contact element, which comprises providing a base body made of a first material having good electrical conductivity and having a first melting temperature; providing a contact layer made of a second material having a less good electrical conductivity, having a sinter structure, being resistant to arc erosion and having a second melting temperature; placing the base body and the sinter structure one above the other in a preferably cup-like mold; and heating the base body and the sinter structure in the mold to a temperature above the first melting temperature but below the second melting temperature, for fusing, penetrating and impregnating the first material into the sinter structure.

In accordance with another mode of the invention, in order to form the sinter structure, the second material may be applied or scattered in powder form onto the first material. Then, both materials are firstly heated to a sintering temperature which is below the melting temperature of the first material, in order to produce the sinter structure, and are then heated to above the melting temperature of the first material. Investigations have shown that, particularly when the mold is formed of steel, the copper wets an inner wall surface of the steel mold, so that if the amount of powder lies at the same level as or below the rim of the mold, the chromium-copper layer which is applied sinks inwards from the edge, so that in the event of a rework in the edge region, the entire contact body layer is removed by turning.

In accordance with a further mode of the invention, for this reason, the mold is overfilled with powder, so that the powder protrudes above the rim of the mold.

In accordance with an added mode of the invention, in order to ensure that the powder does not trickle downwards, a molding ring is placed onto the base body, ensuring that the powder is conically beveled in the edge region. The cone angle is a slope angle which is dependent on the particle size of the powder. At any rate, an angle must be selected which is such that the powder does not trickle down outwards in this region.

In accordance with an additional mode of the invention, the base body also has a cup-like depression, into which the second material is introduced, on its contact side. The edge of the depression should then protrude above the rim of the mold.

In accordance with yet another mode of the invention, in order to achieve a cup-like depression, a ring made of the first material is placed onto the base body, the ring touches the inner wall surface of the mold and the second material, for example, is situated in powder form in the interior of the ring.

In accordance with yet a further mode of the invention, the ring also protrudes above the rim of the mold.

In accordance with yet an added mode of the invention, the second material is placed in the form of an already pre-sintered plate, i.e. in the form of a green body, onto the first material, and in this case too this pre-sintered plate should protrude above the rim of the mold.

With the objects of the invention in view, there is also provided a device for carrying out the method, comprising a cup-like mold formed of metal, preferably steel or stainless steel.

The cup-like mold formed of metal, preferably of steel or stainless steel then remains on the finished contact element as a so-called dead mold. This dead mold has the advantage of mechanically reinforcing and stiffening the contact element on the side situated opposite from the contact surface. If ferritic steel is used, then the wall of the cup mold will advantageously be only partially removed, specifically to such an extent that, in the event of a switching-off operation, the arc does not reach the end rim of the mold made of the ferritic steel. This results in a further advantage: there are various types of contact elements, for example spiral contact elements, between which a radial magnetic field is produced when switching off. In this case, the arc contracts and is set in rotation by the spiral shape. It is beneficial to generate an axial magnetic field, because the axial magnetic field produces a diffuse arc.

In accordance with another feature of the invention, the mold has a wall to be cooled for turning and at least partially removing the wall. If the wall of the mold is only partially removed by turning following cooling, i.e. it is still present at the outer edge of the contact element, then this wall, together with the wall of the opposite contact element, reinforces the axial magnetic field in the peripheral region, which is particularly advantageous if an axial magnetic field is produced between the open contacts by suitable measures.

With the objects of the invention in view, there is additionally provided a device for carrying out the method, comprising a mold formed of ceramic.

Instead of producing the mold completely from ceramic, it may have a bottom made of carbon (graphite) and a wall made of ceramic which is pressed against the bottom. The inner surface of the wall made of ceramic is not wetted by the first material, so that following solidification the surface is convexly curved. $Al_2O_3$ may advantageously be used as the ceramic.

Investigations have shown that, in the event of cooling without further measures, shrink holes may form in the central region, so that such a contact element cannot be used.

In accordance with another feature of the invention, the cooling operation must therefore be controlled in such a way that the cooling in the region of the center axis of the contact element takes place earlier than in the peripheral region.

In accordance with a concomitant feature of the invention, to this end the peripheral region of the contact element is surrounded in the furnace by screening plates which reflect the heat radiated outwards from the edge of the contact element, so that the cooling can take place from the inside, that is to say from the center axis of the contact element. As a result, shrink holes are avoided in the central region and any small shrink holes in the outer region can easily be removed by turning.

If it is intended to produce a contact element which is installed in a vacuum interrupter chamber, oxygen-free, highly conductive copper is used as the copper and the heating is carried out in a high-vacuum melting furnace. In this case, the chromium powder is degassed in the high-vacuum melting furnace at temperatures below the melting point of copper. In the course of this extreme degassing, the powder sinters together to form a rigid, porous structure, and the thickness of the layer only insignificantly changes. Naturally, it is also possible to subject the chromium powder to a compressive force during this degassing operation, which can be carried out by using a corresponding pressure piston. After completion of this process, the system is then briefly heated to above the melting point of copper, so that the porous chromium layer is impregnated in a pore-free manner with high-purity copper.

It is also possible to carry out the method in a protective gas atmosphere, which may be formed of argon or helium, instead of in a vacuum.

Naturally, it is possible to use any type of metal instead of chromium powder, provided that its melting temperature is above the melting temperature of the support body. Accordingly, it is also possible to use any other metal instead of chromium, and also to use mixtures of these metals.

Furthermore, the invention can also be used for producing contact elements for switchgear which are not vacuum switching chambers. If, instead of a plate-like base body shape, the base body has a rounded dome shape, the latter can also be placed in a mold made of steel, for example. The mold is then completely filled with the second material, so that the dome-shaped base body is completely covered. In this case too, it is useful to overfill the mold with the second material in the same essential manner as for the disc-like contact elements.

The thickness of the powder layer also determines the thickness of the contact layer. The proportion of the chromium in the contact layer can be varied depending on the particle size of the powder and the sintering process.

Other features which are considered as characteristic for the invention are set forth in the appended claims.

Although the invention is illustrated and described herein as embodied in a method and a device for producing a contact element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 7 and 8 are fragmentary, sectional views of two further embodiments of a mold according to the invention;

FIGS. 9 and 10 are fragmentary, sectional views of two finished contact elements;

DESCRIPTION OF THE PREFERRED EMBODIMENTS

Figure 1:
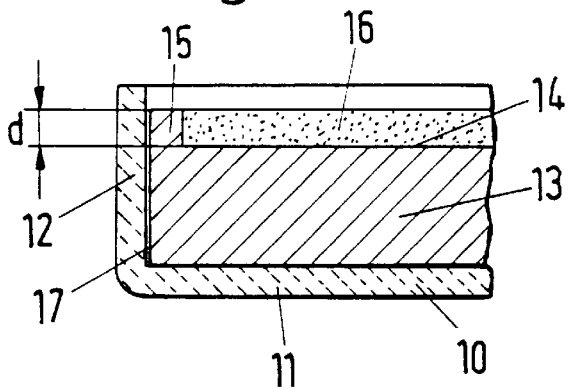
FIGS. 1 to 5 are fragmentary, diagrammatic, sectional views of various configurations of a mold with inserted components.

Referring now to the figures of the drawings in detail and first, particularly, to FIG. 1 thereof, it is seen that in order to carry out the method according to the invention and to produce a contact element having a base body made of material with good electrical conductivity, preferably of copper, and a contact layer, preferably made of chromium-copper, the procedure is as follows:

A base body 13 made of copper is inserted into a cup-like mold 10 having a bottom 11 and a side wall 12. The base body 13 has a cup-like depression 14 with an axially projecting rim or collar 15 on a contact-side surface thereof and chromium powder 16 is filled into the cup mold 14, 15. An annular gap 17 between an inner surface of the mold 10 and an outer surface of the base body 13 should be constructed to be as narrow as possible.

Figure 14:
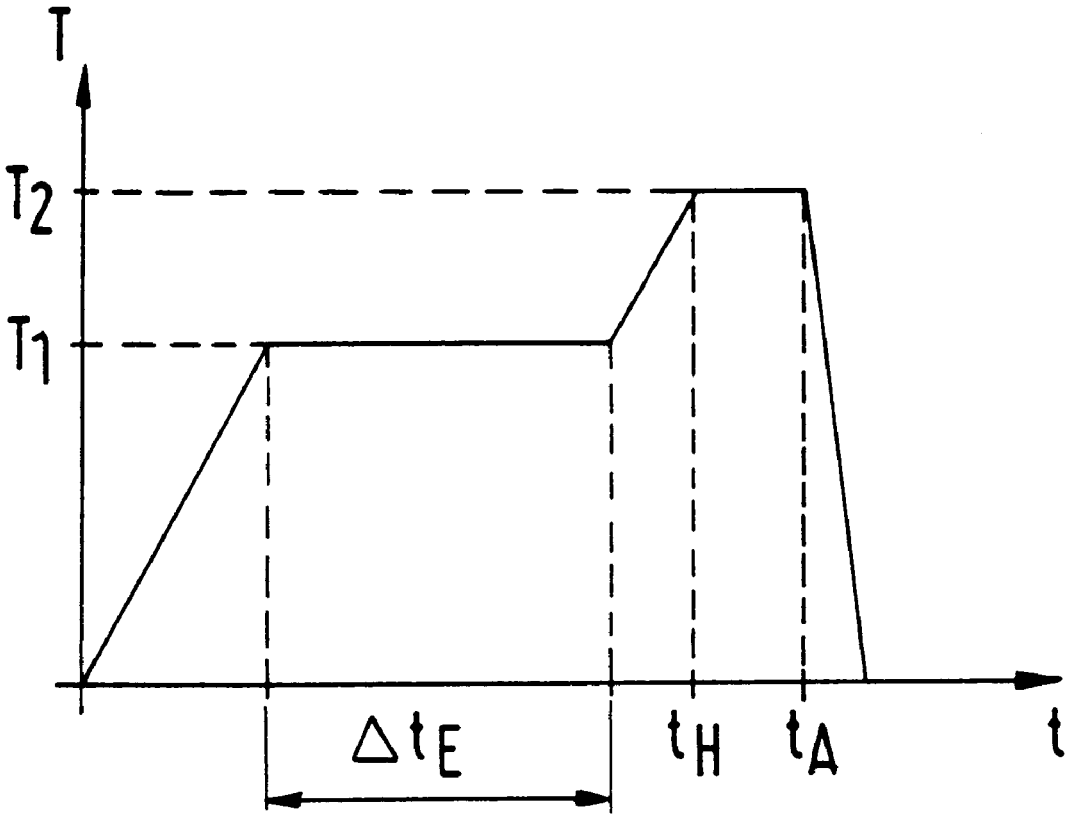
FIG. 14 is a temperature-time diagram for the heat treatment of the contact elements.

Then, the mold 10 with the base body 13 and the chromium powder 16 (which is also referred to below as a contact layer 16) is introduced into a high-vacuum melting furnace and subjected to a heat treatment in accordance with FIG. 14. Firstly, the configuration is heated to a temperature $T_1$ which is below the melting point of the material of which the base body 13 is formed. In the case of copper, this is a temperature of 1083° C. and the temperature $T_1$ must be less than 1083° C. During a period $\Delta t_E$, the configuration is degassed and the powder 16 sinters together by fusion and forms a porous framework, a sinter structure. The sinter structure is impregnated with copper by increasing the temperature inside the furnace to a value $T_2$, which is above the melting point of copper but below the melting point of the chromium powder, so that the contact layer is formed.

Figure 6:
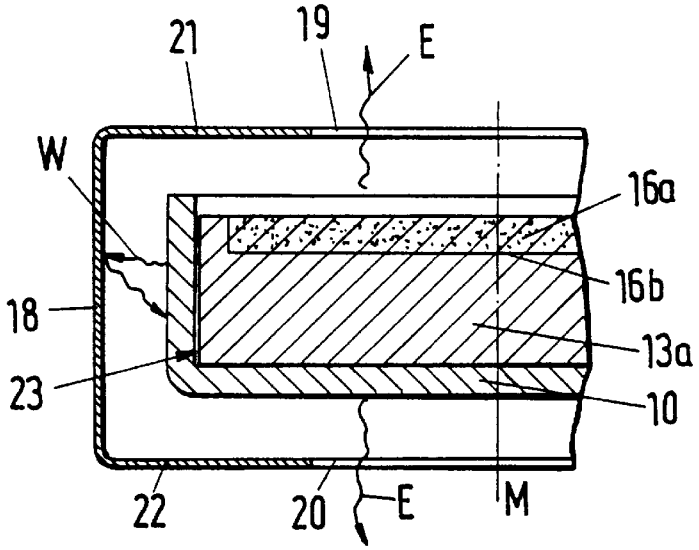
FIG. 6 is a fragmentary, sectional view of a mold having screening plates.

Cooling is then carried out inside the furnace, with a screening 18 disposed around the configuration in accordance with FIG. 6. The screening 18 has walls 21 and 22 which run parallel to the bottom 11 of the mold 10. Each of the walls 21, 22 has a respective opening 19, 20 formed therein in the region of a center axis M—M of the configuration. As a result, thermal energy E can radiate out through the openings 19 and 20, whereas thermal energy W which is radiated from an edge of the configuration is reflected back towards the edge by the screening 18. As a further result, the cooling is controlled from the inside, that is to say from the center M—M outwards, due to which shrink holes are avoided in the region of the center M—M. If any small sink holes should appear in the region of the edge, these can be readily removed by machining. FIG. 6 shows a finished contact element 23 having a contact layer 16*a* and a division plane 16*b*. It can be seen that the rim or collar 15 in the contact layer 16*a* of FIG. 6 has disappeared and the material of this collar has flowed into the sinter structure. The thickness of the contact layer 16*a* depends on the depth or height of the powder layer 16 of FIG. 1.

In the embodiment according to FIG. 1, the mold is made of a material which is not wetted by the copper of the base body 13.

Figure 2:
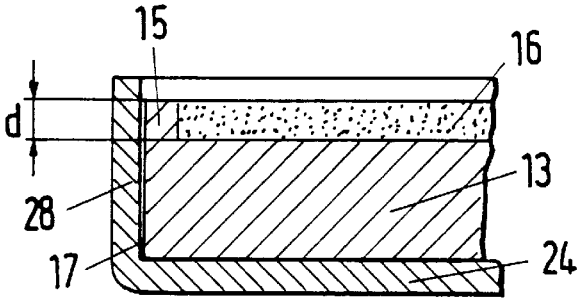

In the embodiment according to FIG. 2, a mold 24 is made of metal, that is of stainless steel or steel. This mold is wetted by copper and is then a so-called dead mold and it forms part of the contact element.

Figure 3:
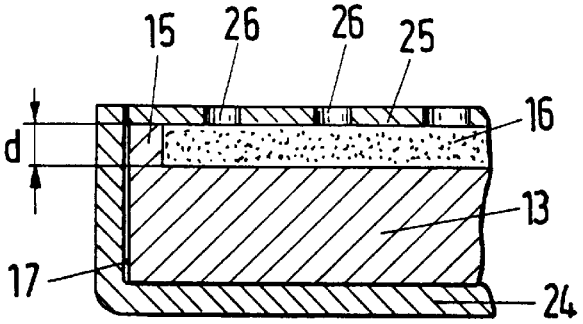

In the embodiment according to FIG. 3, a cover or a plate 25 has been placed on the rim or collar 15. The cover has holes 26 through which gas can escape from the powder during the sintering and degassing operation. If desired, the external diameter of the plate 25 may be smaller than the internal diameter of the collar 15. The plate 25 can then be pressed against the powder with a certain compressive force, as a result of which the size of the cavities formed during the sintering and degassing operation can be influenced.

Figure 4:
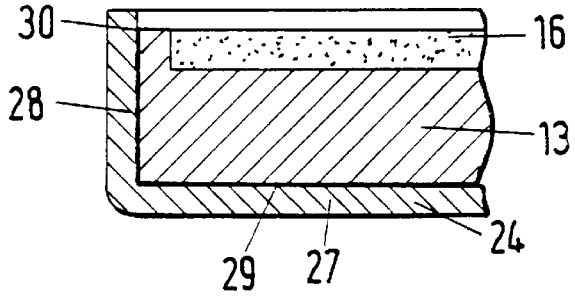

In the embodiment according to FIG. 4, a bottom 27 of the mold 24 and a side wall 28 are coated with ceramic 29 and 30, so that the sintered contact element can be removed from the mold 24. In this case it is also possible to omit the coating 29, so that the copper of the base body 13 wets the bottom 27.

Figure 5:
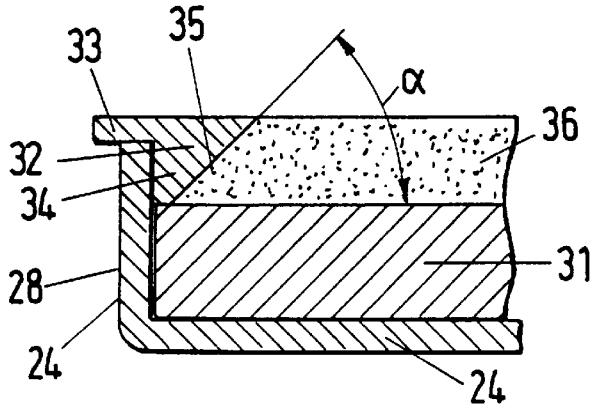

In the embodiment according to FIG. 5, a plate 31 made of copper has been inserted into the mold 24. A rim 32 which has a radial collar 33 and a cylindrical projection 34 is placed onto the plate 31 made of copper. The cylindrical projection 34 has an external diameter which fits precisely inside the wall 28 of the mold 24. An inner surface 35 of the cylindrical projection 34 is conical, and specifically is constructed in such a way that it widens towards the bottom 24. An angle $\alpha$ formed by a generating line and an adjacent surface of the copper plate 31 is to be dimensioned in such a way that powder 36 placed on the plate 31 does not trickle downwards when the ring 32 is removed. In practice, the angle $\alpha$ is a slope angle which depends on the particle size of the powder 36.

It can be seen from FIG. 5 that a free surface of the powder 36 protrudes above a rim edge of the side wall 24. This is to be attributed to the following:

In the embodiment according to FIGS. 2 and 3, there exists the problem of the copper of the base body 13 wetting the side wall 28 of the mold 24. As a result, the copper of the base body 13 on the inner wall surface rises towards the rim of the side wall 28, so that the thickness of the finished contact layer is less in the middle, i.e. at the center M—M, than at the outer peripheral edge. Referring to FIG. 6, the contact layer 16*a* is of concave construction, so that during production of the actual contact element at the peripheral edge there is a risk of the entire contact layer being removed by turning. Such a structure cannot be used. For this reason, the height of the powder layer 36 is selected in such a way that it protrudes above the rim of the side wall 28. The mold 24 is thus overfilled and a contact-element shape is formed in which the division plane 16*b* of the contact layer 16 and of the base body 13*a* is very planar, provided that the adjacent surface of the base body 13*a* was planar. If the adjacent surface of the base body 13*a* has a different form, then this division plane will correspond to this different form, since the sinter structure is affected by this surface of the contact body or base body 13.

Figure 13:
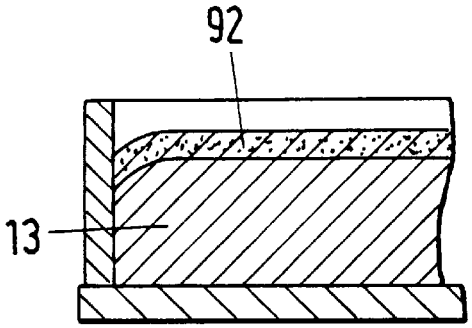
FIG. 13 is a fragmentary, sectional view showing the configuration according to FIG. 12 following a heat treatment.

If the mold is made of a non-wetting material, then a convexly curved surface of the contact layer 16*a* will be formed, as is also seen in FIG. 13.

In order to avoid a concave configuration of the contact layer 16*a*, in accordance with FIG. 7 a base body 70 having a projecting collar 71 forming a depression 72 is dimensioned in such a way that it protrudes above a free rim 73 of a side wall 74 of a mold 75, which corresponds to the mold 24.

Instead of an integrally formed rim or collar 71, according to FIG. 8 a ring 81 may be placed onto a base body 80. The ring has an external diameter which corresponds to the internal diameter of the side wall 74 of the mold 75. The ring 81 protrudes beyond the rim 73.

In the embodiment according to FIG. 9, the side wall 74 of the dead mold 75 is removed by turning. A free rim 76 which is beveled lies below a division plane 77 between a base body 78 and a contact layer 79, so that an arc does not come into contact with the side wall 74 of the mold.

In the embodiment according to FIG. 10, the beveled rim surface or end surface may be replaced by a concave curve 82.

In the embodiment according to FIGS. 9 and 10, the mold 75 is made of ferritic material. As a result, an axial magnetic field 83 is formed in the region of the side walls 74 between the contact element shown in FIG. 9 and FIG. 10 and an identically constructed, opposite contact element, resulting in further advantages, particularly if an axial magnetic field is generated between the opening contact elements by suitable measures.

Figure 11:
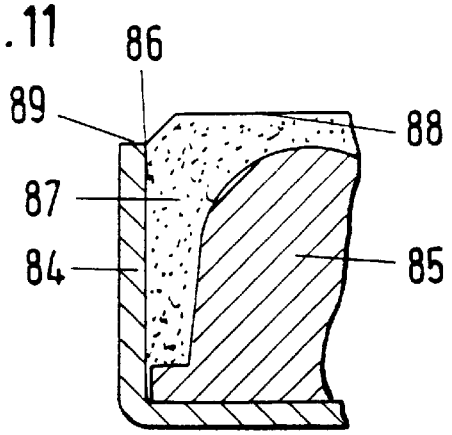
FIGS. 11 and 12 are fragmentary, sectional views of two further embodiments of the invention.

In the embodiments according to FIGS. 1 to 10, the base body is shown as a disc, optionally with a protruding rim. It is also possible, as is seen in FIG. 11, to insert a dome-shaped base body 85 into a mold 84, which corresponds to the molds 24, 75, and to fill a space 86 between the mold 84 and the base body 85 with powder 87. A free surface 88 of the powder protrudes above the rim 89 of the mold 84 and there again forms a slope similar to the slope 35 of FIG. 5. The configuration according to FIG. 11 can then be subjected to a heat-treatment process in the same way as, for example, the configuration according to FIGS. 1 to 6. The dome-shaped base body 85 will then penetrate into the sinter structure which is formed by the powder 87 and a dome-shaped contact element can thus be formed through the use of suitable metal-removing machining. Such a dome-shaped contact element can be used as an arc interruption contact element in a high-voltage circuit breaker in which an insulating gas is used as the extinguishing medium.

The mold according to FIG. 1 is a ceramic mold which may, for example, be made of $Al_2O_3$.

Figure 12:
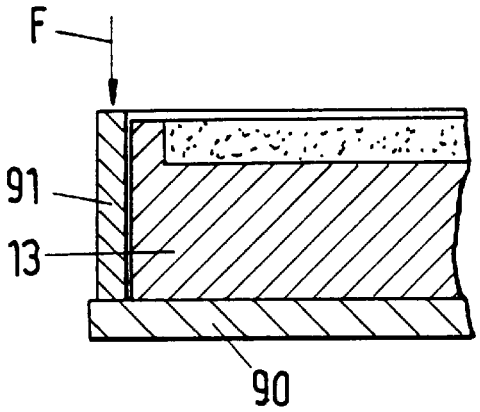

In the embodiment according to FIGS. 12 and 13, a mold is used which has a carbon plate (graphite plate) 90, on which a cylindrical ring 91 made of $Al_2O_3$ is placed. A base body in the ring 91 is placed onto the plate 90. Since the base body is identical to the base bodies according to FIGS. 1 to 4, it is given reference numeral 13. The ring 91 must be pressed against the plate 90 with a mechanical force F, in order to ensure that copper cannot escape through a gap between the ring 91 and the plate 90. Following the heat treatment, which is carried out in the same manner as the procedures described above, a contact layer 92 is convexly curved, in particular at a peripheral edge, since the copper of the base body 13 does not wet the ceramic ring.

Oxygen-free, highly conductive copper is preferably used for the base body in all of the configurations. Chromium powder is used to form the contact layer. It is clear that any kind of materials can be used both for the base body as well as the contact layer, as long as the material of the base body has good electrical conductivity and the material for the contact layer is erosion-resistant and has a low tendency to welding. Copper and chromium are merely conventional materials for this purpose which are conventionally used in vacuum switching chambers. The copper-chromium mixing ratio may, as is known, be adjusted within a wide range by a sintering metallurgy method, so that the electrical resistance, the arc resistance and the tendency to welding can be optimized. The chromium powder may have different particle sizes or may only have one particle size within a narrow size range. It is also possible to use particles of differing forms, and it is also additionally possible to use a mixture of chromium-copper powder to form the sinter structure for the contact layer.

It is disclosed above that all of the sinter structures are produced by applying powder in a flowable form onto the base body and then sintering the flowable powder. It is also possible to place a plate which has been sintered beforehand onto the base body. The considerations which apply for the embodiments according to FIGS. 1 to 13 with regard to convex or concave surface structure should also be taken into account when a sintered plate (green body) is positioned.

When using a mold made of steel or stainless steel, there is the problem of a certain amount of steel becoming alloyed into the copper melt. If necessary, the inner surface of the mold 24 could be covered with a foil made of a material which is insoluble in the copper melt, e.g. tungsten or molybdenum, so that the mold is separated from the copper melt, in a similar manner to the embodiment having the coating 29, 30 of ceramic.

A high-vacuum melting furnace will be used for producing contact elements for a vacuum circuit breaker, in order to ensure that the chromium powder can be sufficiently degassed. A protective gas atmosphere could also prevail in the furnace, at least in the case of the embodiment according to FIG. 11.

We claim:

1. A method of producing a contact element, which comprises:

providing a base body made of a first material having a good electrical conductivity and having a first melting temperature;

providing a contact layer made of a second material having an electrical conductivity less than the electrical conductivity of the base body, having a sinter structure, being resistant to arc erosion and having a second melting temperature;

placing the base body and the sinter structure one above the other in a cup-like mold; and heating the base body and the sinter structure in the mold to a temperature above the first melting temperature but below the second melting temperature, for fusing, penetrating and impregnating only a portion of the first material into the sinter structure to produce a contact element having a layer made from the base body and another layer made from the contact layer.

2. The method according to claim 1, which comprises scattering the second material in powder form onto the first material for forming the sinter structure, initially heating the materials to a sintering temperature or degassing temperature below the first melting temperature to produce the sinter structure, and then heating both materials to above the first melting temperature.

3. The method according to claim 2, which comprises scattering enough powder onto the contact body to cause the powder to protrude above a rim of the mold.

4. The method according to claim 3, which comprises scattering the powder onto the base body in a conically beveled manner in a peripheral region, with a cone or slope angle selected for preventing the powder from trickling downwards.

5. The method according to claim 4, which comprises producing the slope angle with a molding ring placed onto the base body.

6. The method according to claim 1, which comprises introducing the second material in a cup-like depression on a contact side of the base body.

7. The method according to claim 1, which comprises placing a ring made of the first material onto the base body, touching an inner wall surface of the mold with the ring, and introducing the second material into the interior of the ring.

8. The method according to claim 7, which comprises protruding the ring above a rim of the mold.

9. The method according to claim 1, which comprises placing the second material onto the first material in the form of a pre-sintered plate.

10. The method according to claim 9, which comprises sintering the plate to provide a thickness of the plate protruding above a free rim of the mold after being placed onto the base body.

11. The method according to claim 1, which comprises producing the sinter structure from a material selected from the group consisting of chromium, molybdenum, tungsten, hafnium, niobium, tantalum and mixtures thereof.

12. The method according to claim 11, which comprises admixing a sintering aid selected from the group consisting of a metal powder and a readily decomposable metal salt, to the sinter structure.

13. A device for producing a contact element, comprising:

a base body made of a first material having a good electrical conductivity and having a first melting temperature;

a contact layer made of a second material having an electrical conductivity less than the electrical conductivity of the base body, having a sinter structure, being resistant to arc erosion and having a second melting temperature; and a cup-like metal mold receiving said base body and said sinter structure one above the other for fusing, penetrating and impregnating only a portion of said first material into said sinter structure by heating said base body and said sinter structure in said mold to a temperature above the first melting temperature but below the second melting temperature.

14. The device according to claim 13, wherein said cup-like mold is formed of a material selected from the group consisting of steel and stainless steel.

15. The device according to claim 13, wherein said mold has a wall that can be at least partially removed by turning.

16. The device according to claim 13, wherein said cup-like mold is formed of a material selected from the group consisting of austenitic and ferritic steel.

17. The device according to claim 13, wherein said mold has a wall with an inner surface and a ceramic layer covering at least said inner surface of said wall.

18. The device according to claim 13, wherein said metal mold has an inner surface lined with a foil made of a metal not soluble with said first material, for preventing said metal mold from dissolving during fusion of said first material.

19. A device for producing a contact element, comprising:

a base body made of a first material having a good electrical conductivity and having a first melting temperature;

a contact layer made of a second material having an electrical conductivity less than the electrical conductivity of the base body, having a sinter structure, being resistant to arc erosion and having a second melting temperature; and a cup-like mold formed at least partially of ceramic, said mold receiving said base body and said sinter structure one above the other for fusing, penetrating and impregnating only a portion of said first material into said sinter structure by heating said base body and said sinter structure in said mold to a temperature above the first melting temperature but below the second melting temperature.

20. The device according to claim 19, wherein said mold has a bottom made of carbon and a wall made of ceramic and pressed against said bottom.

21. The device according to claim 19, wherein said mold has a bottom made of carbon and a wall made of $Al_2O_3$ and pressed against said bottom.

22. The device according to claim 13, including a metal plate covering said powder layer, joined to said contact layer in a fixed and pore-free manner during the impregnation process and having bores or grooves for degassing.

23. The device according to claim 19, including a metal plate covering said powder layer, joined to said contact layer in a fixed and pore-free manner during the impregnation process and having bores or grooves for degassing.

24. The device according to claim 13, including a furnace controlling a cooling operation for cooling down said contact element more rapidly in a center axis region than in a peripheral region.

25. The device according to claim 19, including a furnace controlling a cooling operation for cooling down said contact element more rapidly in a center axis region than in a peripheral region.

26. The device according to claim 21, including screening plates surrounding a peripheral region of said contact element in said furnace for reflecting heat radiated from an edge of said contact element during cooling and causing cooling to take place from inside and from the center axis of said contact element.

27. The device according to claim 21, including screening plates surrounding a peripheral region of said contact element in said furnace for reflecting heat radiated from an edge of said contact element during cooling and causing cooling to take place from inside and from the center axis of said contact element.

* * * * *